US005794665A

United States Patent [19]

Keim

[11] Patent Number: 5,794,665

[45] Date of Patent: Aug. 18, 1998

[54] JACQUARD MACHINE HOOK SELECTING DEVICE DRIVEN BY A BISTABLE ELEMENT

[75] Inventor: Walter Keim, Senden, Germany

[73] Assignee: Grosse Webereimaschinen GmbH, Burlafingen, Germany

[21] Appl. No.: 633,791

[22] PCT Filed: Oct. 17, 1994

[86] PCT No.: PCT/EP94/03417

§ 371 Date: Jul. 1, 1996

§ 102(e) Date: Jul. 1, 1996

[87] PCT Pub. No.: WO95/11327

PCT Pub. Date: Apr. 27, 1995

[30] Foreign Application Priority Data

| | | | |
|---|---|---|---|
| Oct. 19, 1993 | [DE] | Germany | 43 35 620.6 |
| Aug. 22, 1994 | [DE] | Germany | 44 29 765.3 |

[51] Int. Cl.[6] ..... D03C 13/00; D03C 3/00; D03C 3/24

[52] U.S. Cl. ..... 139/455

[58] Field of Search ..... 139/455

[56] References Cited

U.S. PATENT DOCUMENTS

| | | | |
|---|---|---|---|
| 3,817,292 | 6/1974 | Doehler et al. | 139/55 |
| 3,871,415 | 3/1975 | Wolfgang et al. | 139/59 |
| 5,027,619 | 7/1991 | Saito | 139/455 |
| 5,309,953 | 5/1994 | Speich | 139/455 |

FOREIGN PATENT DOCUMENTS

| | | | |
|---|---|---|---|
| 0 330 624 | 8/1989 | European Pat. Off. | 139/455 |
| 2185702 | 4/1974 | France | 139/455 |
| 515910 | 2/1926 | Germany . | |
| 2119053 | 12/1972 | Germany | 139/455 |
| 22 30 486 | 9/1975 | Germany . | |
| 24 09 421 | 2/1982 | Germany . | |
| 36 39 199 | 1/1989 | Germany . | |
| 668783 | 1/1989 | Switzerland | 139/455 |
| 2273719 | 6/1994 | United Kingdom | 139/455 |

*Primary Examiner*—Andy Falik
*Attorney, Agent, or Firm*—Scully, Scott, Murphy & Presser

[57] ABSTRACT

A Jacquard machine for the positive lifting and lowering of the warp threads in a weaving machine, without the employment of harness cords and a method of operating the Jacquard machine. The Jacquard machine includes for each of a hook (6) a bistable element. The bistable element is formed as an elastically deformable rod (1) or an elastically deformable leaf spring. Periodically, a mechanical deformation loading acts on the bistable element which takes the bistable element into one of two stable states in dependence upon a slight initial deflection. An initialization device (8) brings about a slight deflection of the bistable element before the action of the mechanical deformation loading, in view of which it is ensured that the bistable element takes up a particular one of its two stable states. A hook drive device for the implementing of the mechanical deformation loading on the bistable elements (1) has a loading device (31) for exercising the deformation loading, in which the bistable elements (1) are mounted at least one side thereof.

39 Claims, 8 Drawing Sheets

JACQUARD MACHINE HOOK SELECTING DEVICE DRIVEN BY A BISTABLE ELEMENT

BACKGROUND OF THE INVENTION

1. Field of the Invention

The invention relates to a Jacquard machine which functions without the employment of harness cords, and a method of operating the Jacquard machine in accordance with the invention.

2. Discussion of the Prior Art

In a conventional Jacquard machine, hooks for raising and lowering the warp threads of a weaving machine connected with the Jacquard machine are coupled with driven knives, or released from these knives, in accordance with the weaving pattern to be woven. When the hooks are connected with the driven knives, they carry out a shed-forming lifting and lowering movement. By means of a hook selection device particular hooks can be selected, in dependence upon the pattern to be woven, which are separated from the driven knives and thus do not take part in the lifting and lowering movement. The registering of the pattern is effected by means of a plurality of harness cords which permit a connection through inter-engagement or form fitting or locking—a positive connection—between the hooks and the warp threads during the lowering movement. Respective warp threads in the register of the pattern are connected with respective hooks via harness cords. To provide the connection through force locking or action of a force—a non-positive connection—during the lowering movement, tension springs are in general provided at the end of the harness cords opposite to the hooks.

The employment of harness cords for controlling the lifting and lowering movement of the warp threads is disadvantageous since the harness cords are subject to great wear and the exchange of a torn harness cord during the operation of the weaving machine has the consequence that production must be brought to a halt for a long period of time.

In DE-PS 22 30 486, for the avoidance of this disadvantage, there is proposed a harnessless Jacquard machine. For control of each individual warp thread there is provided a pressing device for coupling a hook provided for each warp thread with two alternately moved lifting knives. The pressing device includes a selection device, which in correspondence to the pattern to be woven selects individual hooks which do not take part in the lifting and lowering of the lifting knives. The hooks are connected, at their underside, the so-called hook floor, in each case with a cord which is engaged with the warp thread to be raised or to be lowered. Since the pressing device, in cooperation with the lifting knives, is however solely capable of delivering the lifting movement of the warp threads, there are provided at the lower ends of the cords tension springs for the lowering movement of the warp threads. DE-PS 22 30 486 discloses the possibility of individual control of the warp threads of the weaving machine and the replacement of the harness cords by means of tear-resistant cords, but for the lowering movement of the warp threads tensioning springs are however still necessary. The known Jacquard machine thus represents a Jacquard machine which during the lifting movement works in a positive manner and during the lowering movement works in a non-positive manner.

From DE-AS 21 19 053 there is known a device which works harnessless, for shed formation in looms. For producing the lifting and lowering movements of the warp threads there is provided for each warp thread a wire or coil element which is connected with the warp thread concerned by means of a cord or rod. The wire or coil elements are arranged in a static magnetic field and are subjected to an electric current. In accordance with the direction of the current the wire or coil elements are deformed or deflected either upwardly or downwardly. The lifting or lowering movement produced by these means is transferred to the warp threads by means of the cords or rods. Such an arrangement is however practically realizable only with difficulty because of the necessary high levels of current and magnetic field strength.

SUMMARY OF THE INVENTION

The object of the present invention is thus to provide a Jacquard machine which works both in the lifting movement and in the lowering movement in a positive manner and makes possible a rapid change of the position of the warp threads. Further, it is the object of the present invention to provide a method of operating the Jacquard machine in accordance with the invention.

DETAILED DESCRIPTION OF PREFERRED EMBODIMENTS

Figure 1:
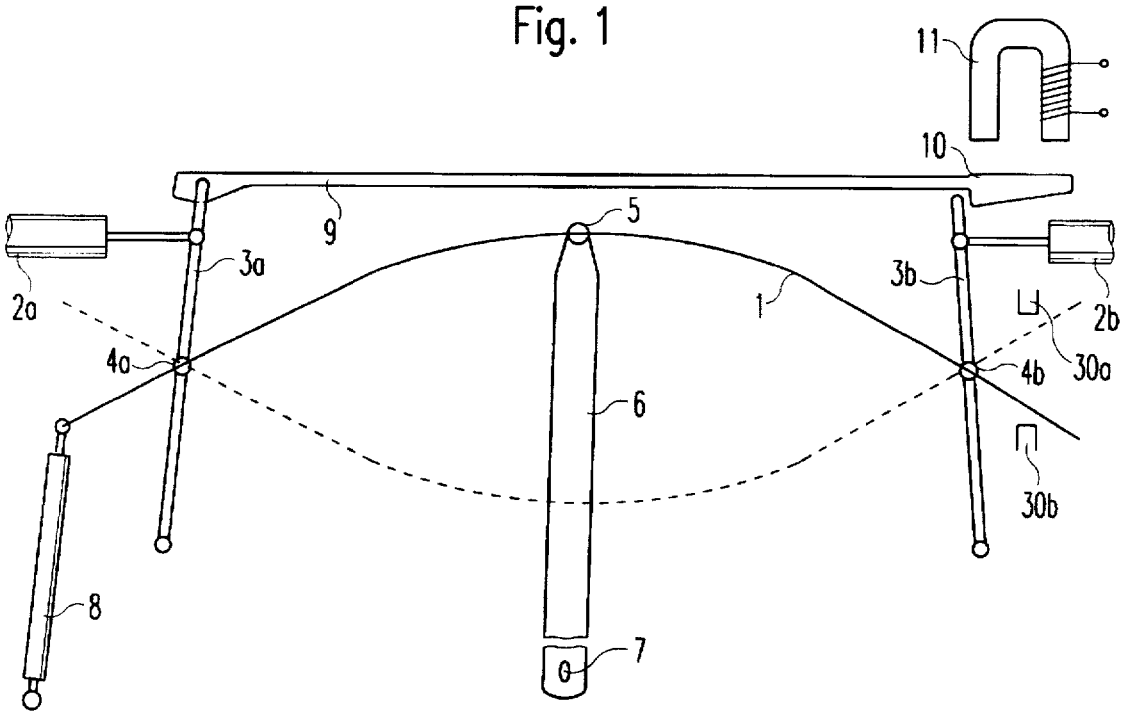
FIG. 1: a first exemplary embodiment of the hook control in the Jacquard machine according to the invention.

The invention is based on the concept that the employment of a bistable element which has, under the effect of a mechanical deformation loading, a first stable positioning state in the lifted position of the hook and a second stable positioning state in the lowered position of the hook offers simple control both of the lifting movement and also of the lowering movement of the hooks. Here and below, the term hook will be employed for a movement element which ensures a positive connection between a (hook) selection device and the warp thread to be controlled. The hook selection device thus has such an effect on the bistable element that a particular one of the two positioning states for the selected hooks can be reliably attained. The hook may be connected with the bistable element either directly or by means of a lifting device or the like.

The bistable element is designed to be elastically deformable, in particular in the shape of a rod or of a leaf spring. The mechanical deformation loading may thereby be effective by means of an axial or longitudinally directed force component on the rod or the leaf spring. This can be brought about through the bringing together of two mounting points arranged in the end region of the rod or of the leaf spring, for example by means of a cam or a hydraulic or pneumatic piston.

Further provided is a locking element which locks the bistable element in one of its stable positioning states. During a locking time it is thus prevented that the associated hook takes part in the lifting and lowering movement. there is also further provided an unlocking element that releases the bistable element after a predetermined locking time.

An initializing device in dependence upon a corresponding control signal brings about a directed initial deflection of the bistable element, whereby the bistable element, after being subjected to the effect of the mechanical deformation loading (as initial condition when the Jacquard machine is brought into operation) takes up a particular one of the two stable positioning states. The initialization device may be operated for example hydraulically, pneumatically, electromagnetically or electrostatically.

The Jacquard machine is operated in one embodiment as an open shed Jacquard machine. Here, the bistable elements change directly between the two stable positioning states and are locked in these states. After each weft insertion of the weaving machine it is determined which hooks must change their states, corresponding to the weaving pattern, for the next weft insertion of the weaving machine. The change of the positioning state of the bistable element is effected by means of unlocking and correctly phased exercise of the mechanical deformation loading, so that the bistable element attains the respective other positioning state.

Pursuant to another embodiment, the Jacquard machine is operated as a closed shed Jacquard machine. After each weft insertion of the weaving machine, the bistable elements return to a neutral positioning state. After selection of the hooks to be raised and to be lowered, a corresponding initial deflection is exercised on each of the bistable elements, so that the bistable elements go over into a particular one of the two stable positioning states through exercise of the mechanical deformation loading.

The above-described Jacquard machine provides for each warp thread of the weaving machine a bistable element, in particular an elastically deformable road or an elastically deformable lead spring which is connected with the associated warp thread in a positive and non-positive manner via a respective hook. By means of an external mechanical deformation loading acting periodically on the bistable element, the bistable element is brought into one of its two stable positioning states and the associated warp thread is correspondingly lowered or raised.

As a further development, mechanical deformation loading can be applied to the bistable elements in a simple manner and after shed formation has been achieved a reliable weft insertion into the weaving machine is ensured. For the implementing of the mechanical deformation loading on the bistable elements there is provided a loading device in which the bistable elements are mounted at least on one side. The loading device is coupled to a drive shaft in a non-positive but not in a positive manner, so that the loading device is carried along by the drive shaft when the loading device is not deactivated. Such a deactivation of the loading device is effected by means of an arresting device when the hooks have attained their raised or lowered state, in order to ensure a reliable weft insertion of the weaving machine, in particular to maintain this state also for a plurality of insertions when this is necessary. Thereby, the loading device has a loading lever which is connected non-positively, in effect, through spring action, with the drive shaft.

An arresting device is constituted as a block brake and in this case may have a pivotally mounted brake lever, which by way of suitable brake blocks of a wear resistant material having a high coefficient friction, from a saw-tooth like engagement arrangement or the like exercise the necessary braking force on appropriate parts of the loading device, in particular by a loading lever, to deactivate the loading device. The brake blocks can here either be mounted directly on the brake lever—arranged on this brake lever—or can be set into the brake lever to avoid shearing off. The configuration as block brake is advantageous because upon an alteration of the swing path of the loading device no adjustment is needed; however, a secure retention in the braking position is significant.

The braking lever of the arresting device can be so pretensioned that a braking force is exercised on the loading device which is sufficient to deactivate the loading device. This has the advantage that the braking force can be applied without further energy-consuming drive means and, for example, upon failure of the operating supply to the machine, the loading device is automatically deactivated.

To release the arresting device, the block brake must be releasable in a suitable manner. This can be effected by means of a cam shaft or an electromagnet. In the released condition, the arresting device can be held by means of an electromagnet, for example engaging on the brake lever for so long until a renewed arresting has to be effected. The electromagnet can also be excited for a short period of time for the purpose of control, and there must then be provision for a secure retention in the released condition, for example in accordance with claim 31 a permanent magnet may be provided which alone, after control by means of the electromagnets, is capable of retaining the brake lever.

Alternatively, the arresting device may be configured as an electromagnetically, pneumatically or hydraulically actuable.. plunger which with appropriate actuation blocks the path of movement of the loading device.

An arresting device constituted as a block brake is further developed by means of an articulated lever which is its extended position deactivates the loading device by means of a brake block and in its folded position releases the loading device. For increasing the braking force there may be further provided, in accordance with claim 34, a braking lever, the force arm and the actuation arm of the braking lever having to be adapted to the braking force necessary for deactivating the loading device.

For actuating the articulated lever there is employed an articulated lever drive shaft arranged on one end of the articulated lever, which drive shaft—like the drive shaft for the loading device—carries out rocking movement in such a manner that the articulated lever is transformed between its extended and its folded position.

In order to fix the articulated lever in its extended position, and thus to arrest the loading device there is provided a suitable retaining device. This retaining device may be formed by means of an electromagnet which co-operates with a return device associated with the articulated lever. Alternatively, the articulated lever may be so constituted that its latches into its extended position. This can be attained by means of overextension of the articulated lever. To release the articulated lever, and thus the deactivated loading device, there may be provided an electromagnetically, pneumatically, hydraulically or similarly actuable plunger.

FIG. 1 shows a first exemplary embodiment of the hook control in the Jacquard machine according to the present invention. There is shown solely the arrangement for a single hook, which is present in a number corresponding to a number of hooks employed. The hook control has a bistable element (in the present exemplary embodiment as elastically deformable rod 1). By means of a hydraulic apparatus 2*a* and 2*b* and a framework 3*a* and 3*b*, the rod 1 can be loaded with a pair of forces acting in axial direction so that a mechanical deformation loading acts upon the rod 1. For this purpose the rod 1 is rotatably mounted in the mounting points 4*a* and 4*b* on the framework 3*a* and 3*b*. The upper stable positioning state of the rod is indicated in the Figure as a full line, while the lower stable positioning state is indicated in the Figure as a broken line. In the middle region of the deformable rod 1, a hook 6 is mounted at a mounting point 5 and connected with the rod 1 in a positive and non-positive manner. At the underside of the hook 6 there is an eye 7 for receiving a warp thread. It is, however, also possible to provide at the underside of the hook an attachment device for a cord or the like, which provides the connection between the warp thread and the hook 6.

After axial loading of the rod 1, this takes up either its upper stable positioning state or its lower stable positioning state. Which of the two stable positioning states is selected depends substantially upon the commencement conditions before the exercise of the axial loading on the rod 1. For proper alteration of these initial conditions, an initializing device 8 maybe provided which in the actual exemplary embodiment is likewise formed as a hydraulic apparatus. The manner of working of the initialization device 8 will be discussed further below. For locking the elastically deformable rod 1 in its stable positioning state there is provided a locking element 9 which is rotatable mounted on the framework 3*a*. On the side of the framework 3*b* the locking element 9 has a catch end 10 into which the framework 3*b* latches after any one of the two stable positioning states of the rod 1 has been attained. When the elastically deformable rod 1 is located in its upper stable positioning state, the warp thread connected therewith via the hook 6 is also in a raised state, while the warp thread is in a lowered state when the elastically deformable rod 1 takes up its lower stable positioning state. During the locking of the rod 1 by means of the locking element 10, the weaving shed of the weaving machine is consequently open.

If, for reason of the pattern to be woven, it is required that the warp thread connected with the hook 6 is to change from the raised into the lowered position, or vice versa, the locking condition is terminated by means of an unlocking element 11 which in the illustrated exemplary embodiment is provided as a controllable electromagnet. Upon excitation, the electromagnet 11 effects a raising of the locking element 9 so that the framework 3*a* and 3*b* is free to move. Through the elastic deformation of the rod 1, it—together with the hook 6—is moved in the direction of the respective other stable positioning state. By means of the kinetic energy present in the neutral position, the dead point located there is overcome and the elastically deformable rod 1 is deformed at least slightly in the direction of the respective other stable positioning state. In this movement phase, the axial loading of the rod 1, effected by means of the hydraulic apparatus 2*a* and 2*b*, is again applied whereby the rod is finally completely deformed in such a manner that it takes up the respective other stable positioning state.

Through this manner of movement, the hook 6 and the warp thread connected therewith are transported from the raised into the lowered state, or vice versa. After attainment of a new stable positioning state of the elastically deformable rod 1, the framework 3*b* again latches into the catch-like end 10 of the locking element 9, so far as the electromagnet is not excited. The deformable rod 1 and the hook 6 remain so long in the raised or lowered state until this state must again be altered in dependence upon the pattern to be woven.

The initializing device 8 serves, in the above-described operation of the Jacquard machine in accordance with the invention as an open shed Jacquard machine, solely for the reliable attainment of the raised or of the lowered state when the machine is first brought into operation, and may also be omitted. In the case of omission of the initializing device 8 it is to be ensured, by means of a suitable pre-deformation of the rod 1, that upon initiation of operations the rod initially takes up a definite one of the two stable positioning states. For this basic or pre-deformation, the weight of the hook 6 may be sufficient. Finally, there is no need for all bistable elements—that is the rods 1—to take up a predetermined positioning state upon initiation of operations, if thereafter a void cycle, without weft insertion of the weaving machine, is effected, in which the initial positioning states of the bistable elements 1 are established.

Further, a sensor element or a pair of sensor elements 30*a*, 30*b* may be provided in order to detect whether the elastically deformable rod 1 is located in the raised or lowered positioning state. The sensor elements 30*a*, 30*b* may be, for example, be constituted as electrical contacts or alternatively as proximity sensors working in a contactless manner. In particular when no initializing device 8 is employed, the sensor elements 30*a*, 30*b* are particularly advantageous since upon commencement of operations of the machine it can be reliably determined in which of the two stable positioning states each of the bistable elements, in the present exemplary embodiment formed as elastically deformable rods 1, are located. The positioning state of those elastically deformable rods 1 which, with regard to the following weft insertion of the weaving machine, are not located in the desired position can then, during the following cycle of the applied deformation force, be taken into the respective other positioning state. The employment of the sensor elements 30*a*, 30*b* is also advantageous after the commencement of operations of the machine since it can be determined at any time whether the elastically deformable rods 1 and the hooks 6 are located in the positioning states in accordance with the weaving pattern. If, for reason of a fault in operation, this is not the case for a particular hook 6, this fault can be removed in the next cycle and thus is not carried through over the entire woven product.

Figure 2:
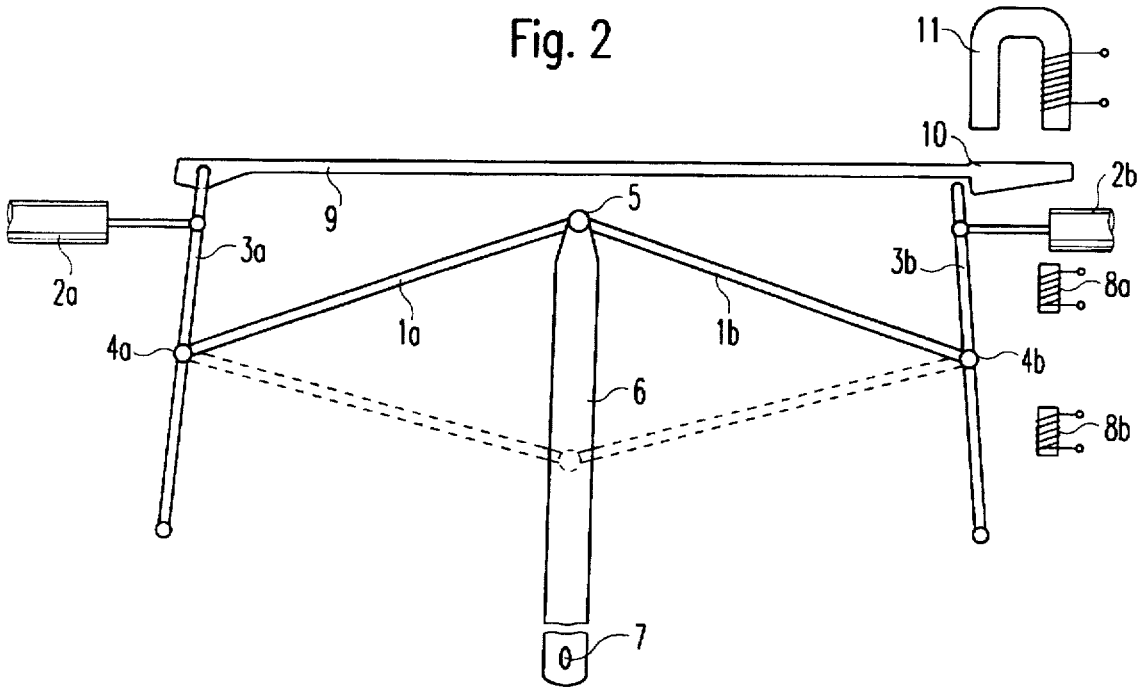
FIG. 2: a second exemplary embodiment of the hook control in the Jacquard machine in accordance with the invention.

In FIG. 2 there is illustrated a further exemplary embodiment of the hook control in the Jacquard machine in accordance with the present invention. Instead of an elastically deformable rod 1 or an elastically deformable leaf spring, the bistable element in the illustrated exemplary embodiment consists of a scissors-like framework 1*a* and 1*b* which engages rotatably into the framework 3*a* and 3*b* at the mounting points 4*a* and 4*b*. The mounting points 4*a* and 4*b* are, as in the exemplary embodiment illustrated in FIG. 1, movable together and apart by means of a hydraulic apparatus 2*a* and 2*b*. The device has further the locking and unlocking device 9–11 already described with reference to FIG. 1. The scissors-like framework 1*a* and 1*b* has an upper, first stable positioning state, illustrated in FIG. 2 by means of a solid line, and a second, lower stable positioning state, illustrated in FIG. 2 by means of a broken line. After the two mounting 4*a* and 4*b* are moved towards one another, the bistable element 1*a*, 1*b* takes up one of the two stable positioning states. A purposive selection of a particular one of the two stable positioning states maybe effected either by means of the hydraulic or pneumatic piston 8 illustrated in FIG. 1 or, as illustrated in FIG. 2, by means of two electromagnets 8*a* and 8*b*. If a control pulse is applied to the electromagnet 8*a*, thus the electromagnet is excited, there is provided a downwardly directed initial deformation of the bistable element 1*a* and 1*b* so that upon bringing together of the two mounting points 4*a* and 4*b* the bistable element 1*a* and 1*b* moves into the lower stable positioning state. Conversely, the bistable element 1*a*, 1*b* goes into the upper stable positioning state after bringing together of the two mounting points 4*a* and 4*b* if a corresponding control pulse is applied to the electromagnet 8*b*, thus this electromagnet is excited (and the other electromagnet 8*a* is de-excited).

A significant difference to the exemplary embodiment illustrated in FIG. 1 consists, for the exemplary embodiment illustrated in FIG. 2, in that the elastic deformation energy of the bistable element cannot be exploited for changing over the deformation loading states. However, the elastic deformation of the warp thread can be exploited in a corresponding manner. Further, the pattern of movement described with reference to FIG. 1 can be attained in that at least upon lifting of the hook 6 during a first movement phase the mounts 4*a*, 4*b* are moved apart from one another by means of active operation of the thrust apparatus 2*a*, 2*b*, while after passage through the dead point, these are again brought towards one another.

It is to be emphasized that the exemplary embodiments illustrated in FIG. 1 and FIG. 2 can be modified or varied in many respects in accordance with the inventive concept. In particular, a section of the elastically deformable bistable element may be formed to be magnetostrictive or electrostrictive, so that the effect of a magnetic or electric field brings about the necessary initial deformation. The thrust apparatus 2*a*, 2*b* need not necessarily be hydraulic or pneumatic. The periodic exercise of mechanical deformation loading on the bistable element can also be effected, for example by means of a gear or a cam of a driven shaft. In particular, it is also possible to provide one of the mounting points 4*a* or 4*b* fixed in position and displace only the other mounting point upon application of the deformation force. Likewise, it is possible to mount the bistable element fixedly or rotatably displaceably at at least two points. The locking element 9 can alternatively lock each of the two ends of the bistable element separately and independently of one another. The unlocking element can, of course also be formed to be mechanically controllable in classic manner.

Figure 3A:
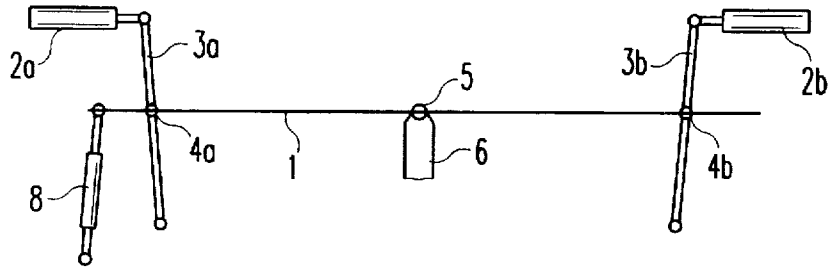
FIG. 3A to FIG. 3E: diagrams for explanation of the hook control in accordance with the invention in various movement phases.
Figure 3B:
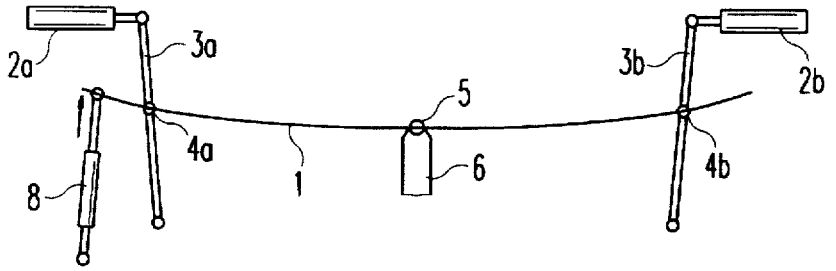

With reference to FIGS. 3A to 3E the operation of the Jacquard machine in accordance with the invention as a closed shed Jacquard machine will be described. It is assumed that the elastically deformable rod 1, which in the present exemplary embodiment forms the bistable element, returns to a neutral initial position illustrated in FIG. 3A after each weft insertion of the weaving machine. The neutral condition of the elastically deformable rod 1 corresponds to the closed condition of the weaving shed of the weaving machine, e.g. all warp threads have in the weaving machine an approximately equal level. After determination of which of the warp threads are to be lifted for the next weft insertion of the weaving machine, and which warp threads are to be lowered, corresponding control signals are transferred to all initialization devices 8 which are provided for all hook control devices. In the present exemplary embodiment, the initialization device 8 is formed as hydraulic or pneumatic piston. The initialization device effects a slight initial deflection which can deform the bistable element 1 in the direction of the lowered positioning state, as shown in FIG. 3B, or in the direction of the raised positioning state, as shown with reference to FIG. 3D. The deformation force thereby necessary may be minimal. It is solely required that by means of the subsequent action of the mechanical deformation loading, which is generated in the illustrated exemplary embodiment by means of the hydraulic or pneumatic thrust apparatus 2*a*, 2*b* the bistable element, e.g. the rod 1 moves into a particular positioning state unambiguously determined by means of the initial deflection.

Figure 3C:
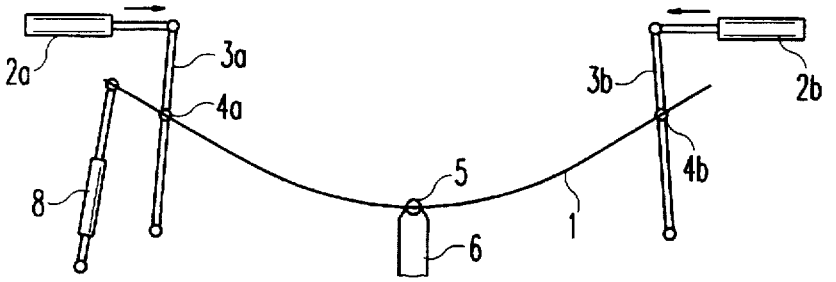
Figure 3D:
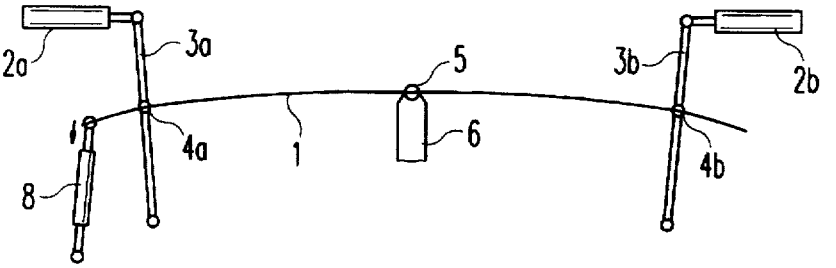
Figure 3E:
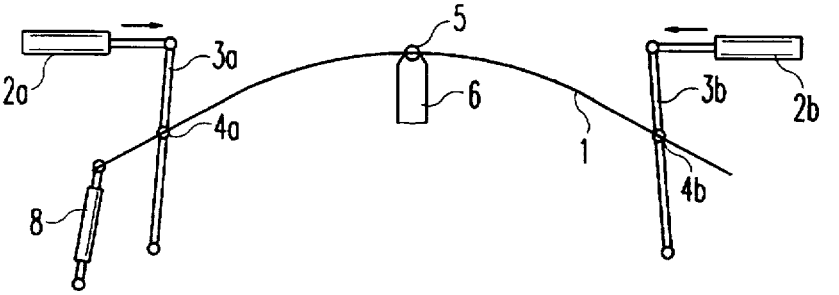

The complete deformation of the bistable element 1, up to attainment of one of the stable positioning states, is represented in FIG. 3C and 3E respectively for the upper and the lower positioning state. The deformation loading from the thrust apparatus 2*a*, 2*b* is transferred to the elastically deformable rod 1 by means of the framework 3*a*, 3*b*. After ending of the exercise of the elastic deformation loading, the elastic deformable rod 1 again relaxes into the neutral condition illustrated in FIG. 3A. The described procedure is periodically repeated after each weft insertion of the weaving machine.

Figure 4:
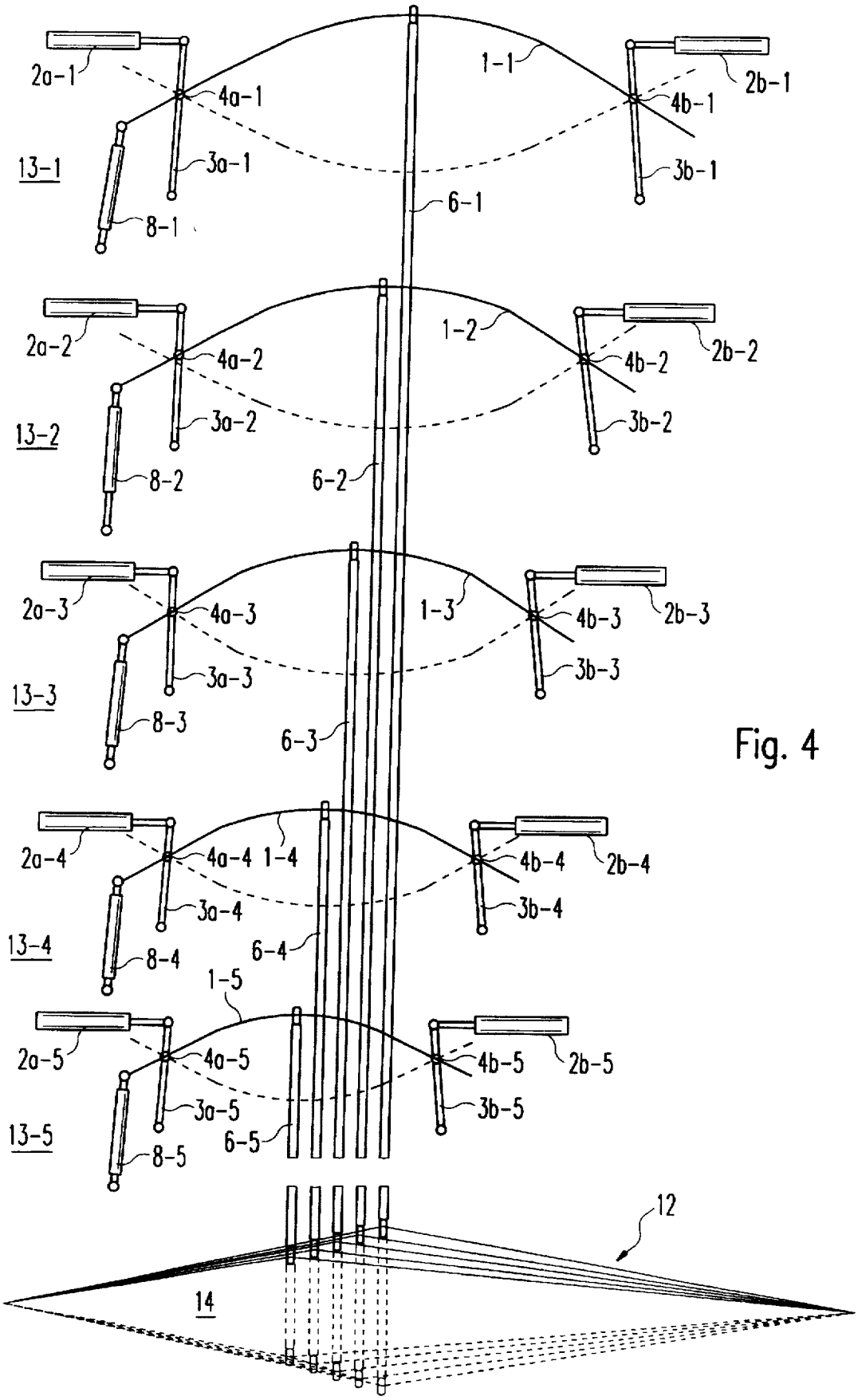
FIG. 4: cascade arrangement for increasing the density of the hooks in the Jacquard machine according to the invention.

FIG. 4 shows a cascade-like arrangement of the hook control devices 13-1 and 13-5 in accordance with the invention.

In the tensioning direction of the warp threads 12 several (in the illustrated exemplary embodiment 5) hooks 6-1 to 6-5 are provided into which there engage respective different warp threads 12. The associated hook control devices 13-1 to 13-5 are arranged one above the other. Through the elimination of the harness cords from the Jacquard machine in accordance with the invention the space provided in conventional Jacquard machines for spanning the harness cords is now available for the arrangement of the hook control devices in accordance with the invention above one another and alongside one another. The exemplary arrangement illustrated in FIG. 4 refers to the exemplary embodiment of the hook control device 13 illustrated in FIG. 3. The individual hook control devices 13-1 to 13-5 work as explained with reference to FIG. 3A to 3E. The individual control devices 13-1 to 13-5 may, however, also be formed as explained with reference to FIGS. 1 and 2. The individual hook control devices 13-1 to 13-5 function as explained with reference to FIGS. 1 and 2 or FIGS. 3A to 3E.

By means of the hooks 6-1 to 6-5, arranged offset in the deflection direction of the warp threads 12, and the arrangement of the individual hook control devices 13-1 to 13-5 one above another, the effective space requirement of an individual hook control device in the weft direction of the weaving machine, e.g. perpendicular to the tensioning direction of the warp threads 12, can be substantially reduced. In the weft direction of the weaving machine, the arrangement illustrated in FIG. 4 may be formed with offset repeats as often as necessary in order to be able to individually control each individual warp thread. By means of broken lines there is illustrated the lower stable positioning state of the bistable elements 1-1 to 1-5 and the lowered state of the hooks 6-1 to 6-5 and of the warp threads 12. When all warp threads 12 are in the raised or lowered state, the weaving shed 14 is formed between them.

Figure 5:
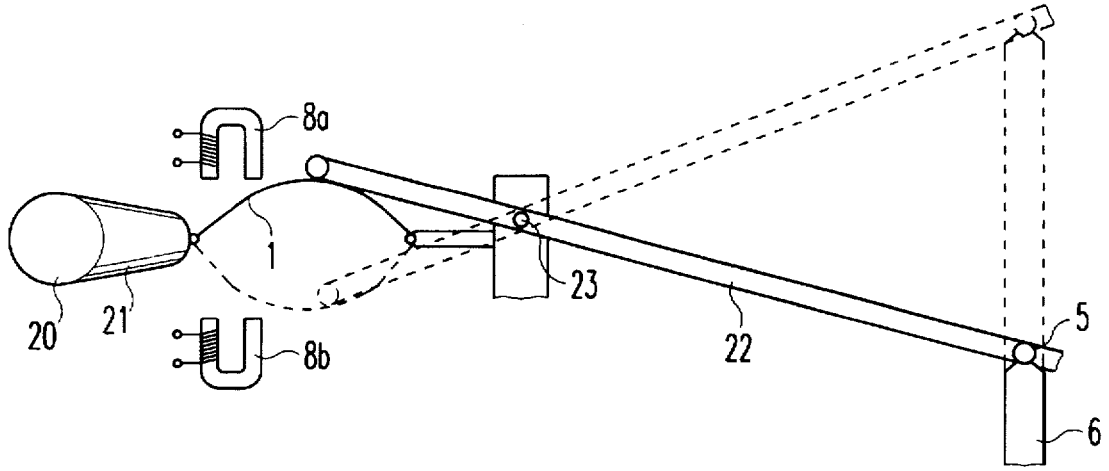
FIG. 5: a third exemplary embodiment of the hook control in the Jacquard machine according to the invention.

FIG. 5 shows a further exemplary embodiment of the hook control device in accordance with the invention. Differently from the forms of embodiment illustrated up to now, the hook 6 is not directly connected with the bistable element 1 but is connected non-positively with the bistable element, here again a rod 1, by means of a lever device 22 which is rotatably mounted at a position 23. The raised condition of the hook 6 and the corresponding position of the rod 1 and of the lever device 22 is indicated in FIG. 5 by means of broken lines. Also differently from the forms of embodiment illustrated above, the mechanical deformation loading acting on the rod 1 is periodically applied by means of a cam 21 sitting on a driven shaft 20. The end of the rod 1 away from the cam 21 is mounted in a fixed location. By means of the electromagnets 8*a* and 8*b* respective particular ones of the two stable positioning states of the rod 1, as described above with reference to FIG. 2, can be reliably selected. Before action of the cam 21 on the rod 1, the rod experiences an initial deflection either in the direction of the raised or in the direction of the lowered positioning state. The employment of the lever device 22 in the illustrated exemplary embodiment exhibits the advantage that the hook stroke or the force for lifting and lowering the hook 6 may be varied.

Figure 6:
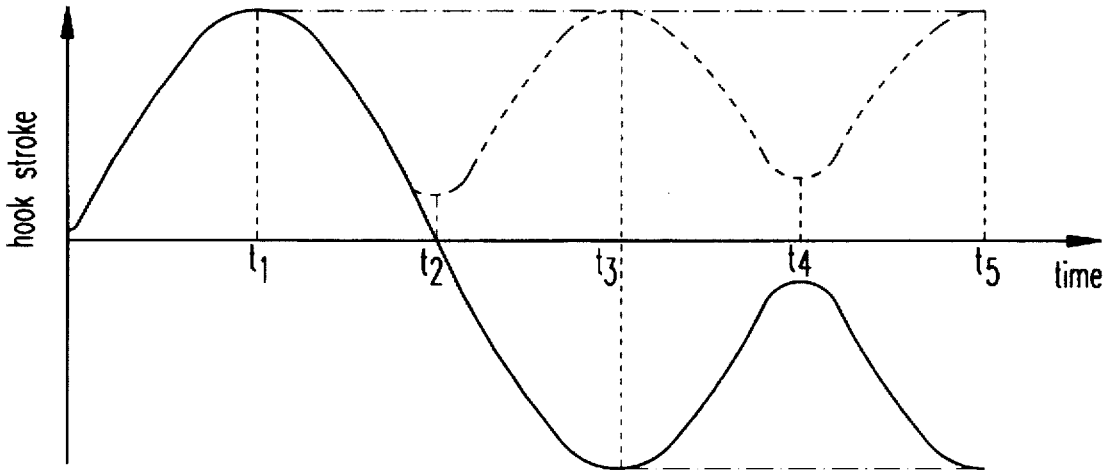
FIG. 6: a hook stroke/time diagram for explanation of the manner of working of the Jacquard machine in accordance with the invention.

FIG. 6 shows the temporal development of the hook stroke for differing manners of operation of the Jacquard machine in accordance with the invention. It is assumed that after commencement of operations of the Jacquard machine initially every second hook is raised and the other hooks are lowered. Then, those hooks are selected which upon the next weft insertion of the weaving machine must have the state just taken up—in FIG. 6, the raised state. The temporal development of the positioning of these hooks is indicated by means of a chain line. The other, previously raised hooks, are lowered during the time period $t_1$ to $t_3$. Within a predetermined temporal tolerance range around the time point $t_3$, the weft insertion of the weaving machine may be effected. Thereafter, it is again determined which hooks—with regard to the next subsequent weft insertion of the weaving machine—are already in the correct state. These hooks remain during the time period $t_3$ to $t_5$ in the raised or lowered state, while the other hooks change their positioning state during this time period. The next weft insertion of the weaving machine takes place in a temporal tolerance range around the time point $t_5$, etc. This applies also, in inverse fashion, for the hooks which are lowered in the initial step.

Figure 7:
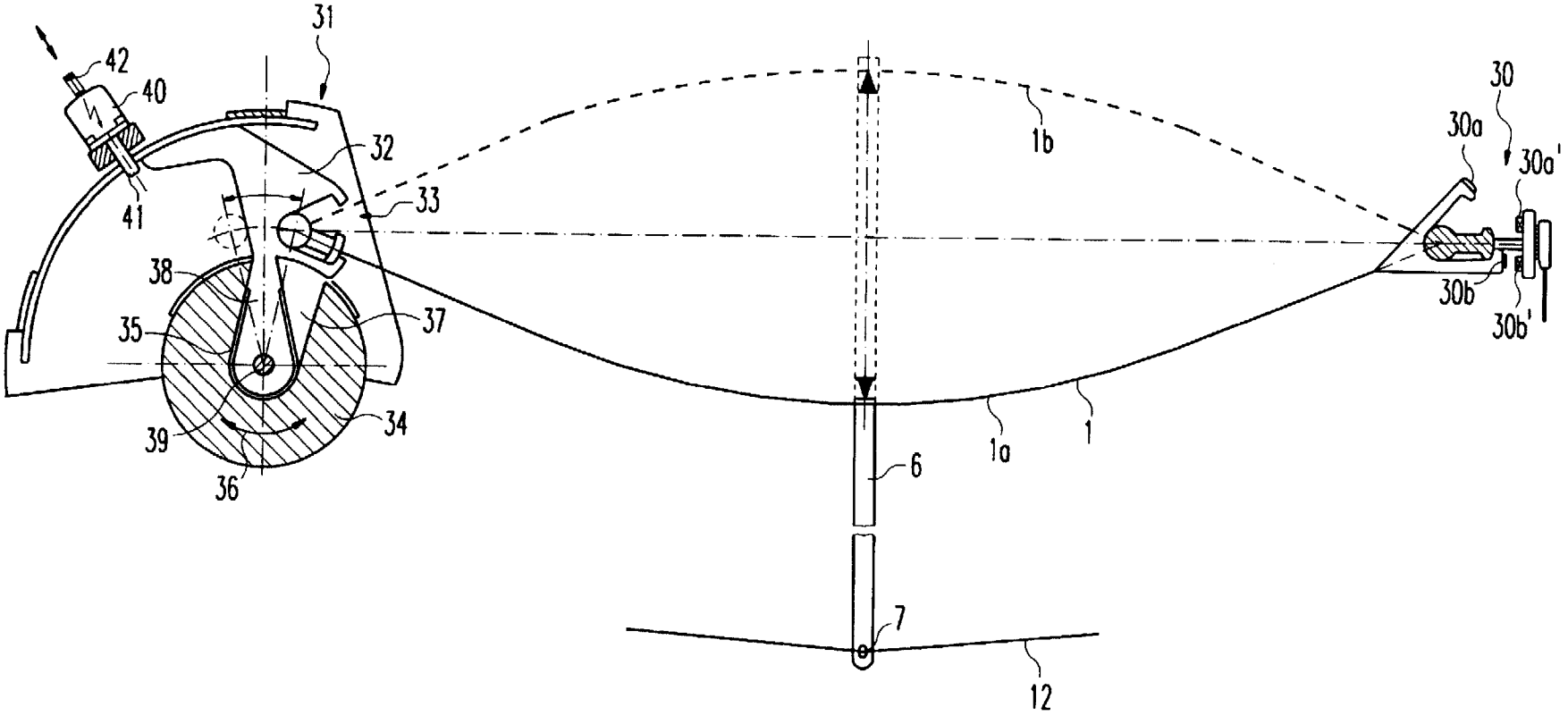
FIG. 7 a transverse generally diagrammatic section through a first further development of the hook drive device according to the invention, including hook selection device.

A section through a first further development of the hook drive device in accordance with the invention is shown in FIG. 7. Furthermore, there can be seen from the Figure further significant elements of the proposed Jacquard machine. As already explained, the Jacquard machine has a mechanically deformable bistable element 1 which in the illustrated further development is formed as an elastic deformable rod. This bistable element 1 can however also have other configurations, e.g. in the form of a leaf spring. For each warp thread of the weaving machine there is provided such a bistable element which in each case is connected with the warp thread 12 by means of a merely schematically represented hook 6 and an eye 7. Through deformation of the bistable element 1, either into the lowered state 1*a* or into the raised state 1*b*, the associated warp thread 12 is either lowered or raised, in order to form a suitable weaving shed.

The bistable element 1 is part of a hook drive device of the Jacquard machine. For deformation of the bistable element 1, the hook drive device further has a loading device 31 to be explained below, by means of which the bistable element is acted upon with a substantially axially acting elastic deformation loading.

The Jacquard machine has further a hook detection device 30 in order to detect the lowered state 1*a* or the raised state 1*b* of the bistable element, separately for each bistable element. In the further development according to FIG. 7, the hook detection device 30 is schematically represented by means of two sensor element arrangements 30*a*, 30*a*' and 30*b*, 30*b*', e.g. hall effect sensors, piezo elements, or the like. When the bistable element 1 concerned is in its lowered state, illustrated by solid lines, the sensor element parts 30*b* and 30*b*' lie opposite one another so that this state can be detected. Agreement with the pattern data can be determined and the necessity for a control action checked. This is in particular necessary following an initialization operation. In similar manner, the held state is detected by means of the sensor element parts 30*a* and 30*a*'.

For the application of the mechanical deformation loading, the loading device 31 has a loading lever 32. In the loading lever 32, there are provided mounting elements 33 for the mounting of the bistable element 1. The loading device can receive either several or all bistable elements 1 of the Jacquard machine, there being expediently provided a separate loading lever 32 for each bistable element 1, whereby the loading levers are arranged—in the width extension of the Jacquard machine, which is not shown—offset one next to the other, or can be so arranged. The loading lever 32 is coupled to the drive shaft 34 in a non-positive but not in a positive manner and is rotatably mounted on an axis 39 arranged concentrically to the drive shaft 34. A corresponding coupling between the loading lever 32 and the drive shaft 34 can be effected either in a simple manner by means of frictional linkage or advantageously via a coupling spring, in particular a leaf spring. For reducing the friction, an open hole 35 (a depression) may be provided. The drive shaft 34 carries out an oscillating or rocking movement, indicated by the arrow 36, in which the loading lever 32 takes part, so far as an arresting device—to be described below—is not actuated. In order to make possible the movement of the drive shaft 32 also when the loading lever 32 is deactivated by means of the arresting device to be described below, this arresting device has, in the illustrated development, a recess 37 in which the lower end 38 of the loading lever 32 is freely moveable.

Furthermore, the hook drive device according to the invention has an arresting device in order that the loading device—in the illustrated development the loading lever 32—can be deactivated when the bistable elements 1 have attained either their raised state 1*b* or lowered state 1*a*. In relation thereto, the following differing further developments will be described.

The further development illustrated in FIG. 7 has, as a particularly simple solution, a plunger 41 actuable by means of an electromagnet 40, which plunger blocks the path of movement of the loading lever 32 at a suitable point. The bistable elements 1 then remain for so long in their loaded state 1*a* or 1*b* until the plunger 41 is removed from the path of movement of the loading lever 32 by means of the electromagnet 40 and the loading lever 32 is carried along by the drive shaft 31 anew. Of course, the plunger 41 can be actuated, instead of electromagnetically, also pneumatically or hydraulically or in other suitable manner. In order to retract the plunger 41, a return spring 42 may be provided.

Figure 8:
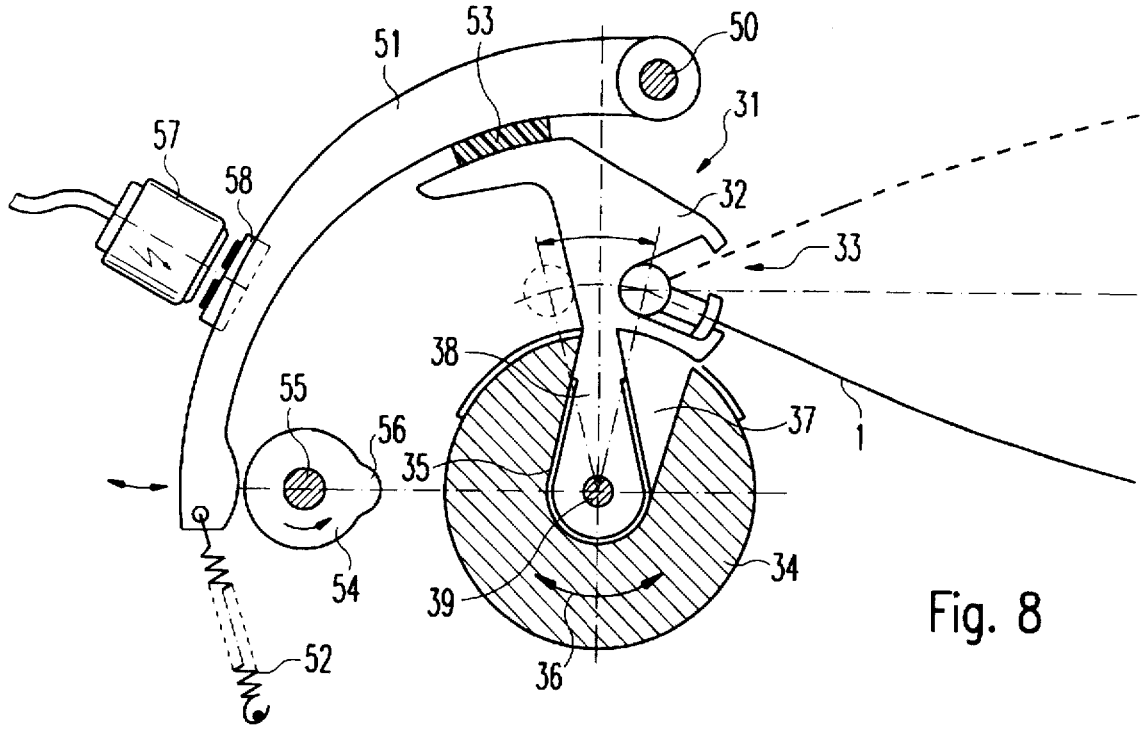
FIG. 8 a section similar to FIG. 7, shown on an enlarged scale, through a second further development of the invention.

FIG. 8 shows a further development of the arresting device. The arresting device in accordance with FIG. 8 has a braking lever 51 rotatably mounted on an axis 50. The braking lever 51 is, for example by means of a merely schematically illustrated tensioning spring 52, pretensioned in such a manner that the braking lever 51 exercises via a brake block 53, on the loading lever 52, a force sufficient to deactivate the loading lever 32. By means of the braking lever 51, a suitable braking force amplification is attained. In order to again release the loading lever 32, after ending of the arresting procedure, there is necessary a suitable device for lifting up the braking lever 51. For this purpose there is provided, in the development according to FIG. 8, a cam shaft 54 which rotates around an axis 55 and does this synchronously with the rocking movement. The cam 56 of the cam shaft 54 lifts the braking lever 51, for releasing the loading lever 32, up so far that the brake block 53 is brought out of engagement with the loading lever 32. For holding the loading lever 51 in the raised position a corresponding holding device is needed. This can be realized in a simple manner by means of an electromagnet 57 which can co-operate with a permanent magnet 58 arranged on the opposite side of the braking lever 51 in order to make possible a holding of the released (lifted) braking lever 51 in this position without the consumption of energy. Upon "offering", e.g. by means of the cam shaft 54, two conditions are thus possible: if the electromagnet 57 is excited it has a magnetic field of the same polarity (as the permanent magnet 58), for which reason no attraction but rather repulsion, takes place; if the electromagnet is not excited (de-excited), then the permanent magnet 58 alone holds the braking lever 51, in a currentless manner, against the return force (spring 52) in the open position. In a simplified form of configuration, instead of such a permanent magnet on the side of the braking lever 51 opposite to the electromagnet 57 there can be provided a region with a material of high magnetic permeability. The release of the braking lever 51 from the electromagnet 57 is effected by means of the spring force exercised by the tension spring 52 and/or by reversal of the current direction of the electromagnet 57.

An arrangement according to the rule of "kinematic reversal" is likewise possible.

There is to be provided for the brake block 53 preferably a material of lowest possible wear with a high coefficient of friction. The brake block 53 may either, as in the illustrated further development, be attached to the underside of the braking lever 51 or, alternatively, to the overside of the loading lever 32. There may also be provided a saw-tooth like engagement arrangement with a brake block cushion, as is schematically indicated in FIG. 2 on the corresponding surface on the loading lever 32.

Figure 9:
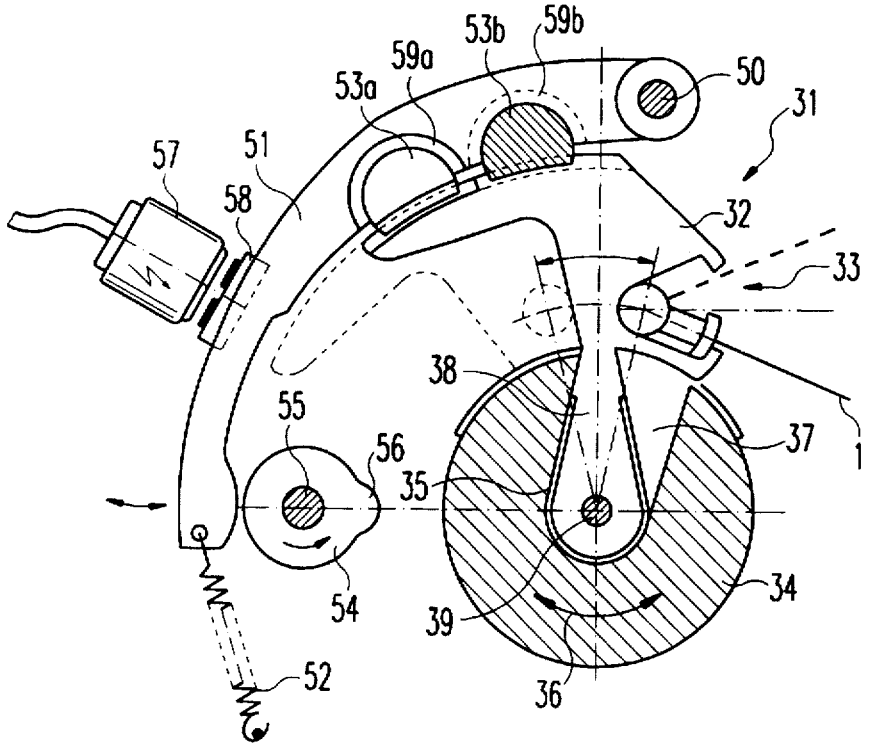
FIG. 9 a section similar to FIG. 7, shown on an enlarged scale, through a third further development of the invention.

The further development illustrated in FIG. 9 corresponds to the greatest extent to the development described above with reference to FIG. 7. Differently from FIG. 8, in the development according to FIG. 9, two brake blocks 53*a* and 53*b* arranged one behind the other are provided. The brake blocks, formed as segments of spheres, can be pressed into corresponding recesses 59*a* and 59*b* so that a rapid and simple installation of these consumables is ensured. By means of the secure seating of the brake blocks 53*a* and 53*b* a shearing off of the same upon operation of the device is largely avoided.

The further developments to be described below, illustrated in FIG. 10 to 13, differ from the above-described further development in that an articulated lever 60 is employed as a further configuration of the arresting device formed as brake block.

The loading device 31 illustrated in FIG. 10 has the elements already described with reference to FIGS. 7 to 9, namely a loading lever 32, mountings 33 for the bistable elements 1 and a drive shaft 34 which carries out a rocking movement. Reference is therefore made to the above description.

The articulated lever 60 consists of the articulated lever elements 60*a* and 60*b*, whereby the lower articulated lever element 60*b* may be elastically formed, e.g. as U-shaped leaf spring. The articulated lever elements 60*a* and 60*b* are mounted rotatably with respect one to the other in the mounting element 60*c*. The upper articulated lever element 60*a* stands in engagement with the braking lever 51 and is likewise pivotally connected with this braking lever via the bearing element 61. For its part, the braking lever 51 is pivotally mounted on the axis 50 and acts by means of the brake block 53 on the loading lever 32. In the condition of the arresting device with extended articulated lever 60 (unstable condition), illustrated in FIG. 10, a braking force is effected by means of the braking lever 51 and the brake block 53 on the loading lever 32 which arrests this lever. In the condition of the arresting device illustrated in FIG. 11, the articulated lever 60 is in contrast folded (stable condition) and, via the braking lever 51, lifts the brake block 53 up so far that the loading lever 32 is released. In the released condition according to FIG. 11, the loading lever 32 is thus carried along by the drive shaft 34 as described above and carries out the above-described rocking movement, which is indicated in FIG. 11 by means of broken lines.

Figure 10:
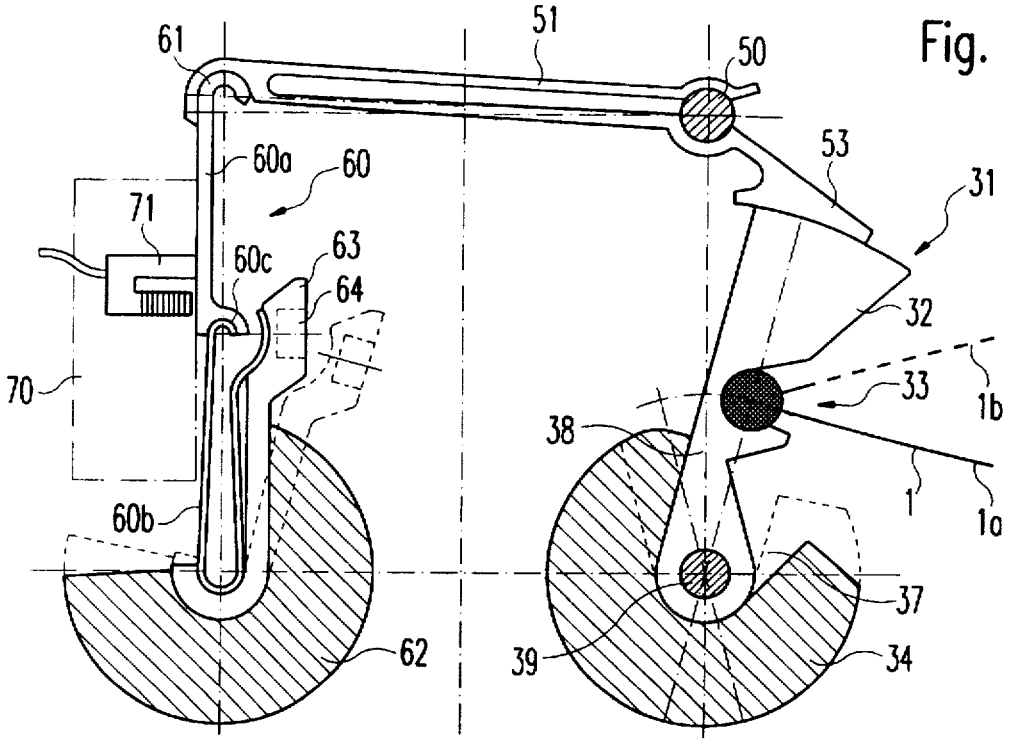
FIG. 10 a section through a fourth further development of the invention with the employment of an articulated lever in extended position.
Figure 11:
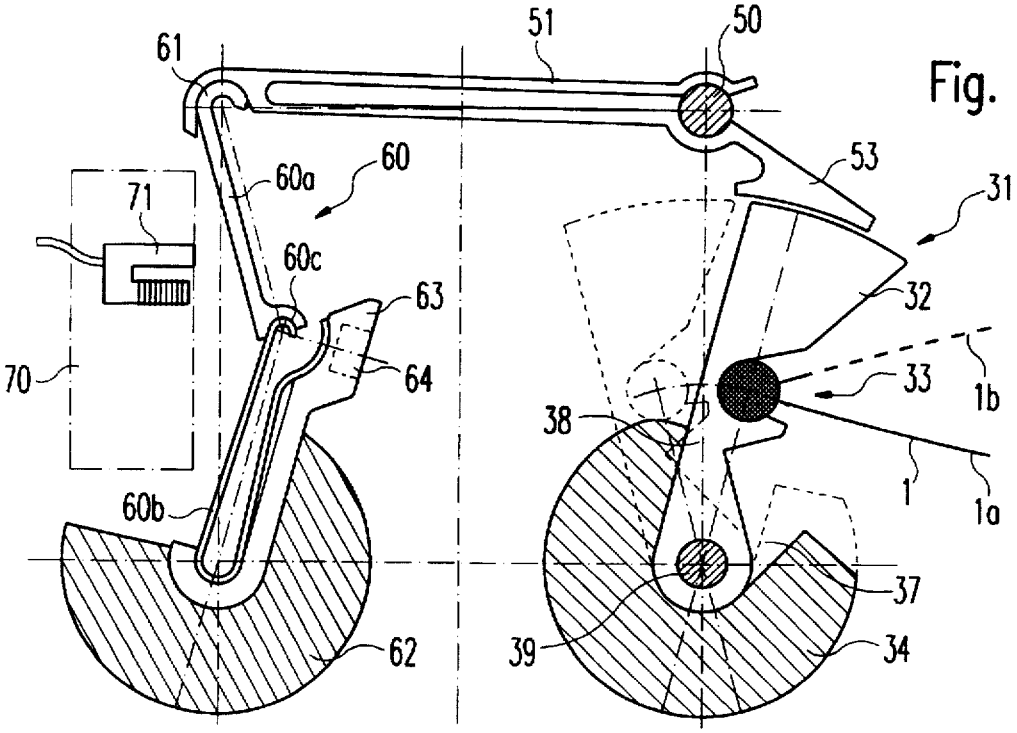
FIG. 11 a section through a fourth further development of the invention with the employment of an articulated lever in folded position.

In order to take the articulated lever 60 from its extended condition shown in FIG. 10 into the folded condition shown in FIG. 11, and vice versa, there is provided at the lower end of the lower articulated lever element 60*b* an articulated lever drive shaft 62 which carries out a rocking movement which is synchronous with the rocking movement of the drive shaft 34. By means of the rocking movement of the articulated lever drive shaft 62, the articulated lever is in each case taken from its folded condition illustrated in FIG. 11 into the extended condition illustrated in FIG. 10. Whether the articulated lever 60 is, conversely, taken from the extended condition illustrated in FIG. 10 into the folded condition illustrated in FIG. 11, depends upon whether a holding device 70 is activated. By means of the holding device 70, the articulated lever 60 is held in its extended condition for so long as the arresting of the loading lever 32 is necessary. For releasing the loading lever 32 the articulated lever 60 is released by means of deactivation of the holding device 70, so that the brake block 53 of the braking lever 51 goes out of engagement with the loading lever 32. The holding device 70 must exercise a sufficiently high holding force on the articulated lever 60 so that the deformation of the lower articulated lever element 60*b*—formed elastically in the illustrated development—is not able to release the articulated lever 60 in the course of the rocking movement of the articulated lever drive shaft 32.

The holding device 70 may be formed, corresponding to the further development in accordance with FIG. 10 and 11, in a simple manner as an electromagnet 71.

Figure 12:
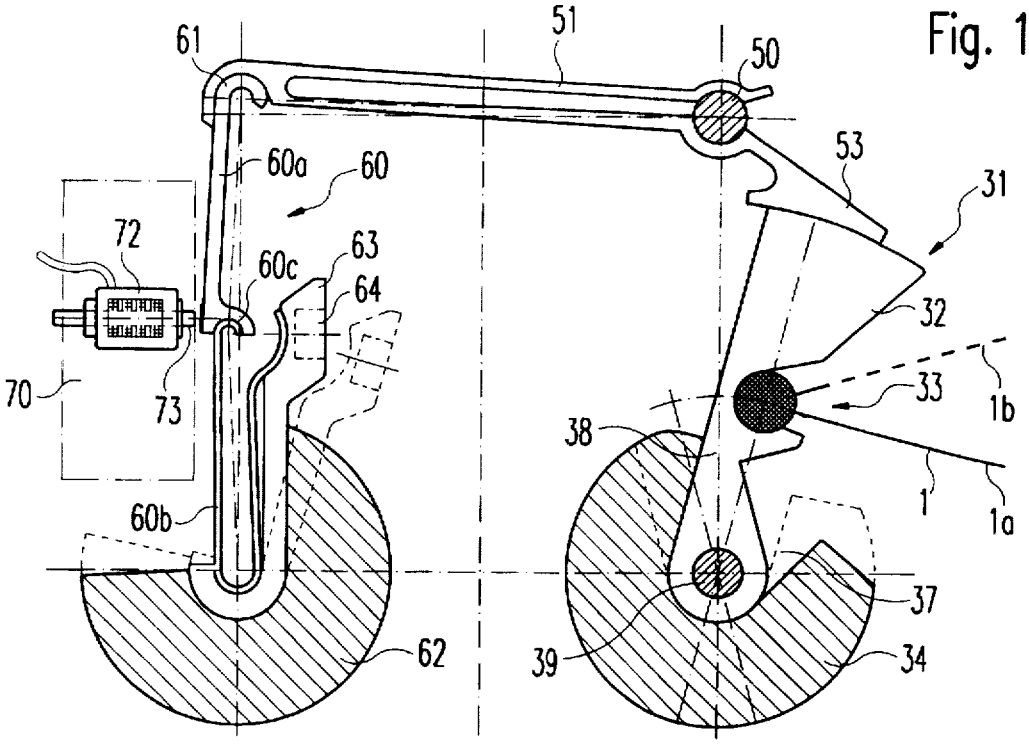
FIG. 12 a section through a fifth further development of the invention with employment of an articulated lever in extended position.
Figure 13:
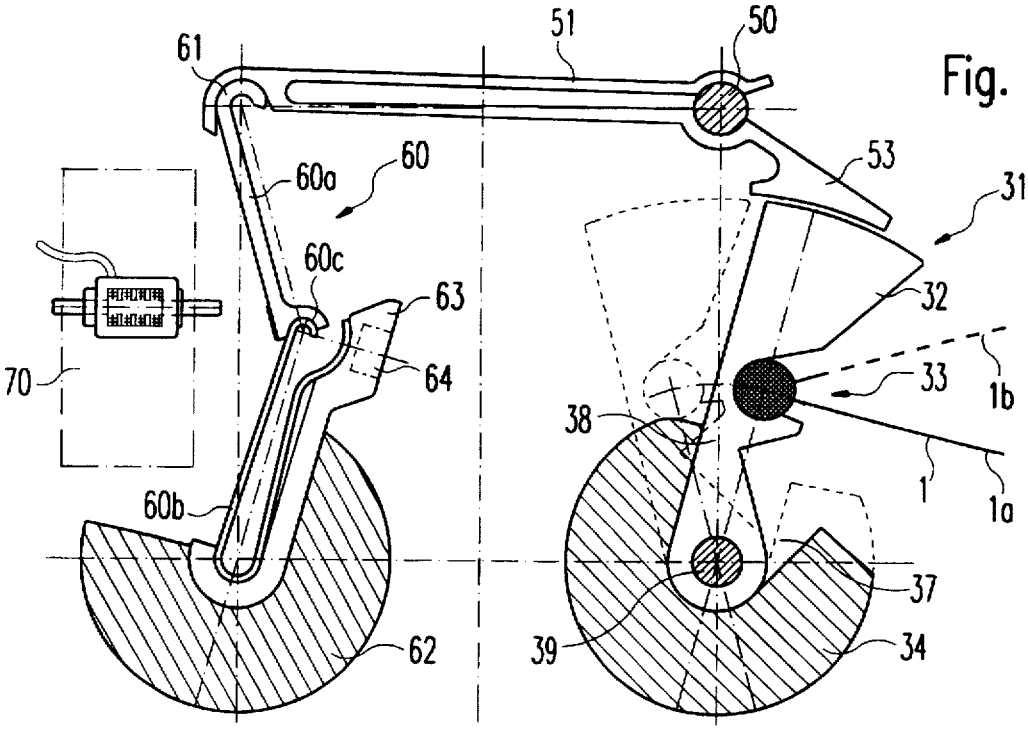
FIG. 13 a section through a fifth further development of the invention with employment of an articulated lever in folded position.

Another further development of the holding device for the articulated lever 60 is illustrated in FIGS. 12 and 13. The further development according to FIGS. 12 and 13 is to the largest extent identical with the development described above with reference to FIGS. 10 and 11, so that a detailed description is not needed. The fixing of the articulated lever 60 in the extended condition illustrated in FIG. 12 is, in this development, attained in that the articulated lever 60 is slightly overextended and thus fixed in this condition. A corresponding fixing could alternatively be realized by means of a latching mechanism. For releasing the articulated lever 60, the holding device 70 has, in the illustrated development, a plunger 73 actuable by means of an electromagnet 72, which plunger upon actuation presses against the articulated lever 60 and releases it. The actuation of the plunger 73 could, of course, be effected in similar manner pneumatically or hydraulically. Also, corresponding to FIGS. 8 and 9, an electromagnet could co-operate with a permanent magnet.

The movement of the articulated lever drive shaft 62 during the rocking movement of the articulated lever drive shaft 62, with the articulated lever 60 fixed in the extended position, is indicated in FIGS. 10 and 12 by means of broken lines. There may be provided in a carrier 63 on the articulated lever drive shaft 62 a permanent magnet 64 which reliably lifts the lower articulated lever element **60*b*—co-operating therewith—from the holding device 70 upon the rocking movement of the articulated lever drive shaft 62 when the holding device is not controlled for holding the articulated lever 60 in the extended condition. The carrier 63 ensures that upon the rocking movement, an "offering" of the articulated lever to the holding device 70** takes place.

The above-described hook drive device is suitable, as can be appreciated, admirably for the drive of a Jacquard machine which works in accordance with the principle of FIGS. 1 to 6. It can also be provided in a double-sided manner at both ends of the bistable element 1. Further, instead of electromagnetic components, other controllable components, e.g. piezo elements may be provided. Of significance is the control function.

Alternatively, the Jacquard machine can also work as quasi-closed shed Jacquard machine. In this case, each hook which does not need to change its state does not remain in the raised or lowered state, but are so far lowered or raised that the neutral positioning state of the bistable element is approximately obtained. There remains, however, a certain deflection in the direction of the previously assumed positioning state. Those hooks which are to change their positioning states overstep however the neutral state of the bistable element and receive a slight deflection in the direction of the other stable state of the bistable element. As soon as the mechanical deformation loading again has effect on the bistable element, those hooks which have not stepped beyond the neutral state of the bistable element are returned into the previous positioning state, while those hooks which have stepped beyond the neutral state of the bistable element before exercise of the mechanical deformation loading are in each case taken into the respective other positioning state. The advantage of this manner of operation of the Jacquard machine is to be seen in that at a time point t2, t4 etc. in each case approximately closed shed position of the weaving shed can be attained which may be of significance for the quality of the woven product.

I claim:

1. Jacquard machine having hooks (6) for raising and lowering warp threads (12) in a weaving machine, a hook drive device (1, **2*a*, 2*b*; 1, 20, 21) for selectively imparting a lifting or lowering movement to the hooks (b); and a hook selection device (8, 9, 11), which selects particular ones of the hooks (6) in order to hold the warp threads (12) connected with said selected hooks (b) characterized that, the hook drive device (1, 2*a*, 2*b*; 1, 20, 21) includes for each said hook (6) deformable bistable element (1) driving the hook in a positive manner, said deformable bistable element responsive to an external mechanical loading acting periodically on the deformable bistable element (1) alternatively takes up a first stable positioning state which corresponds to a raised state of the hook (6), or a second stable positioning state, which corresponds to a lowered state of the hook (6), and means causing the hook selection device (9–11) to impart a mechanical deformation to the bistable deformable element (1**) to produce after each period of the mechanical loading a specific one of the two stable positioning conditions for the selected hooks (b), and a neutral positioning condition in the absence of any mechanical loading.

2. Jacquard machine according to claim 1, characterized in that, the hooks (6) are in direct connection with the associated deformable elements (1) and the first stable positioning state of each deformable element (1) takes up a position which is raised relative to the second stable positioning state.

3. Jacquard machine according to claim 1 or 2, characterized in that, the hooks (6) are connected in a non-positive manner with the respective associated deformable elements by means of a lever device (22, 23).

4. Jacquard machine according to claim 1, characterized in that, each said deformable element (1) is elastically deformable.

5. Jacquard machine according to claim 4, characterized in that, each said deformable element (1) is formed as and elastically deformable rod, or as an elastically deformable leaf spring.

6. Jacquard machine according to claim 5, characterized in that, a force generating component is provided for bistably deforming the elastically deformable rod or the elastically deformable leaf spring in two directions transverse to the axis or longitudinal direction of the rod or leaf spring.

7. Jacquard machine according to claim 5, characterized in that, the elastically deformable rod or the elastically deformable leaf spring is mounted at points in end regions thereof connected at least to one side to mechanical loading means, and the associated hook (6) is connected with the middle region of the rod or the leaf spring in a non-positive manner.

8. Jacquard machine according to claim 7, characterized in that, the rod or the leaf spring is rotatably or pivotably mounted in its end regions and the deformation is achieved by means of the moving together of the two mounting points (**4*a*, 4*b***).

9. Jacquard machine according to claim 7 characterized in that, the hook selection device has a locking element (9) which so locks the deformable element (1) in the first and/or second stable position state that it remains in the relevant positioning state also after the action of the mechanical loading.

10. Jacquard machine according to claim 9 characterized in that, the locking element (9) fixes the mounting points (**4*a*, 4*b***) of the rod or the leaf spring at a fixed spacing from one another after they have been moved together.

11. Jacquard machine according to claim 9 characterized in that, the hook selection device further has an unlocking element (10) which unlocks the locking element (9), in dependence upon a control signal, and thus releases the deformable element (1).

12. Jacquard machine according to claim 11 characterized in that, the unlocking element (11) is electrically actuable, by means of an electromagnet.

13. Jacquard machine according to claim 12 characterized in that, an initializing device (8; 8*a*, 8*b*) is provided which, in dependence upon a control signal, brings about a directed initial displacement of the deformable element out of its neutral positioning state in such a manner that the deformable element (1) after action of the mechanical loading takes up a particular one of the two stable positioning states.

14. Jacquard machine according to claim 13, characterized in that, the initialization device is formed by means of one, or by means of a pair of electromagnets (8*a*, 8*b*) in order to apply a force component to the deformable element, after application of an electrical control signal, in such a manner that a corresponding initial deflection is brought about.

15. Jacquard machine according to claim 13, characterized in that, the initialization device has a hydraulic or pneumatic piston (8) which is connected with the deformable element and after being acted upon with a working pressure or working vacuum brings about the initial deflection of the deformable element.

16. Jacquard machine according to claim 13, characterized in that, the deformable element (1) has, at least in one portion thereof, magnetostrictive or electrostrictive properties and the initial deflection is brought about by means of action of a magnetic or electric field on the relevant section of the deformable element (1).

17. Jacquard machine according to claim 1 characterized in that, the periodical mechanical loading is brought about by means of a cam sitting on a driven shaft or by means of a hydraulic or pneumatic piston periodically acted upon with a working pressure.

18. Jacquard machine according to claim 1, characterized in that, in the vicinity of the deformable element there are provided sensor elements (30*a*, 30*b*, 30*a*', 30*b*') for detecting the positioning state of the deformable element (1).

19. Jacquard machine according to claim 1, characterized in that, the deformable element is formed as a scissors-like framework (1*a*, 1*b*; FIG. 2) which bistably kinks outwardly in response to an axial deformation loading.

20. Jacquard machine according to claim 1, characterized in that, a plurality of hook drive devices (13-1, 13-2, 13-3, 13-4, 13-5) are arranged in a cascade-like manner for operating a plurality of hooks (6-1, 6-2, 6-3, 6-4, 6-5) arranged offset in the direction of the warp threads.

21. Hook drive device for a Jacquard machine according to claim 1 characterized by, a loading device (31) for exercising a mechanical loading on the deformable bistable element (1) which is mounted in the loading device (31), a drive shaft (34) which carries out a rocking movement, said drive shaft being load-transmissively connected with the loading device (31), the loading device (31) having a pivotably mounted loading lever (32) which is load-transmissively connected with the drive shaft (34), and an arresting device (40–42; 50–59; 50–73) for deactivating the loading device (31) when the hooks (6) have reached their raised or lowered state.

22. Hook drive device according to claim 21, characterized in that, the arresting device (50–73) is formed as a block brake.

23. Hook drive device according to claim 22, characterized in that, the arresting device (50–73) has a pivotably mounted braking lever (51) which acts upon one or more brake blocks (53; 53*a*, 53*b*) of a wear resistant material having high coefficient of friction, out of a saw-tooth like engagement arrangement or the like.

24. Hook drive device according to claim 23, characterized in that, the brake blocks (53; 53*a*, 53*b*) sit (FIG. 2) on the brake lever (51), arranged thereon, or are set into the brake lever (FIG. 3).

25. Hook drive device according to claim 23, characterized in that, the brake lever (51) is so pretensioned, in particular by means of a spring (52), that there is exercised upon the loading device (31) a braking force sufficient to deactivate the same.

26. Hook drive device according to claim 21 characterized in that, the arresting effect exercised by the arresting device (50–53) is releasable by means of a cam shaft (54) and/or an electromagnet (57).

27. Hook drive device according to claim 26, characterized in that, the arresting device (50–53) is held in the released condition by means of an electromagnet (57) at least for a short period of time for purpose of the exercise of control.

28. Hook drive device according to claim 27, in that for holding the arresting device (50–53) after the exercise of control in the released condition there is provided a permanent magnet (58) which can alone hold the arresting device against a return of the loading device (31).

29. Hook drive device according to claim 21, characterized in that, the arresting device (40–42) has a plunger (41) actuable electromagnetically, pneumatically, hydraulically or by like means, which plunger blocks the path of movement of the loading device (31).

30. Hook drive device according to claim 22, characterized in that, the arresting device (50–73) has an articulated lever (60) which in an extended condition (FIG. 10, 12) deactivates the loading device (31) by means of a brake block (53) operatively connected to said lever (60) and in a folded condition (FIG. 11, 13) release he loading device (31).

31. Hook drive device according to claim 30, characterized in that, a brake lever (51) is provided by means of which the articulated lever (60) acts upon the brake block (53).

32. Hook drive device according to claim 30 characterized in that, an articulated lever drive shaft (62) is provided at one end of the articulated lever (60), which drive shaft so effects a rocking movement that the articulated lever (60) can be transformed between its extended and folded condition.

33. Hook drive device according to claim 30 characterized in that, a holding device (70) is provided which fixes the articulated lever (60) in its extended position in order to deactivate the loading device (31) by means of the brake block (53).

34. Hook drive device according to claim 33, characterized in that, the holding device (70) has an electromagnet (71).

35. Hook drive device according to claim 34, characterized in that, the electromagnet (71) of the holding device (70) cooperates with a return device associated with the articulated lever (60), such as a spring or a permanent magnet (64) provided on the articulated lever drive shaft (62).

36. Hook drive device according to claim 30, characterized in that, the articulated lever (6) is overextended in the extended condition so as to latch the loading device in this position, and can be released from this position by operating structure consisting of a plunger (73) which is selectively actuable electromagnetically, pneumatically, and hydraulically.

37. Method of operating a Jacquard machine as an open shed Jacquard machine, having hooks (6) for raising and lowering warp threads (12) in a weaving machine, a hook drive device (1, 2*a*, 2*b*; 1, 20, 21) having deformable bistable elements for selectively imparting a lifting or lowering movement to the hoods (6); and a hook selection device (8, 9, 11), which selects particular ones of the hooks (b) in order to hold the warp threads (12) connected with the selected said hooks (6) in a raised or lowered state; comprising the following steps:

a) applying a mechanical loading on the deformable bistable elements (1) so that the deformable bistable elements (1) take up one of two stable positioning states, the hooks (6) consequently take up either the raised or the lowered state and the weaving shed of the weaving machine is opened;

b) locking the deformable bistable elements (1);

c) determining for each hook (6) whether the present raised or lowered state of the hook (6) corresponds to the state needed for the next weft insertion of the weaving machine in accordance with the weaving pattern, and selecting those deformable bistable elements (1) whose associated hooks (6) are not present in the required state;

d) changing the state of the deformable bistable elements (1) selected in step c), by means of unlocking the selected deformable bistable elements (1) so as to relax these selected bistable elements;

correctly phasing the application of the mechanical loading, in order to deform the deformable bistable elements (1) anew, in the direction of the respective other stable positioning state, and locking the applicable selected deformable bistable elements (1) after attainment of the respective other stable positioning state, and periodically repeating steps c) and d) after each weft insertion of the weaving machine.

38. Method according to claim 37, wherein the warp threads (12) are guided by the hooks (6) to cause the threads to take up an approximately closed shed position prior to each weft insertion of the weaving machine.

39. Method of operating a Jacquard machine as a closed shed Jacquard machine, having hooks (6) for raising and lowering warp threads (12) in a weaving machine, a hook drive device (1, 2*a*, 2*b*; 1, 20, 21) including deformable bistable elements for selectively imparting a lifting or lowering movement to the hooks (6); and a hook selection device (8, 9, 11), which selects particular ones of the hooks (6) in order to hold the warp threads (12) connected with the selected said hooks (6) in a raised or lowered state; comprising the following steps:

a) bringing the deformable bistable elements (1) into a neutral positioning state in which the hooks (6) take up an intermediate state lying between the raised and lowered state, and in which the weaving shed of the weaving machine is closed;

b) determining which of the hooks (6) must be present in the raised state and which of the hooks must be present in the lowered state upon the next weft insertion of the weaving machine in correspondence with a specified weaving pattern, and selection of the hooks to be raised and to be lowered;

c) bringing about an initial deflection for each of the deformable bistable elements (1) in the direction of the first positioning state for the hooks (6) which are to be raised and in the direction of the second positioning state for the hooks (6) which are to be lowered;

d) exercising a mechanical loading on all said deformable bistable elements (1) so that, in dependence upon the initial deflection, said deformable bistable elements take up one of the two stable positioning states; and e) effecting periodic repetition of steps a) to d) after each weft insertion of the weaving machine.

* * * * *